United States Patent [19]

Cohen

[11] 4,355,203

[45] Oct. 19, 1982

[54] STEREO IMAGE SEPARATION AND PERIMETER ENHANCEMENT

[76] Inventor: Joel M. Cohen, P.O. Box 135, Brookline, Mass. 02146

[21] Appl. No.: 185,135

[22] Filed: Sep. 8, 1980

Related U.S. Application Data

[63] Continuation-in-part of Ser. No. 129,971, Mar. 12, 1980, Pat. No. 4,308,423.

[51] Int. Cl.[3] ..... H04R 5/00

[52] U.S. Cl. ..... 179/1 G; 179/1 P

[58] Field of Search ..... 179/1 G, 1 GP, 1 GQ, 179/1 P

[56] References Cited

U.S. PATENT DOCUMENTS

| | | | |
|---|---|---|---|
| 3,249,696 | 5/1966 | Van Sickle | 179/1 G |
| 3,697,692 | 10/1972 | Hafler | 179/1 G |
| 3,849,600 | 11/1974 | Ohshima | 179/1 G |
| 3,892,624 | 7/1975 | Shimada | 179/1 G |
| 4,072,914 | 2/1978 | Haramoto | 179/1 P |

OTHER PUBLICATIONS

"On the Advanced Stereophonic Reproducing System 'Ambience Stereo'", Sakamoto et al., Audio Engineering Society, Preprint 1361, 5/2/1978.

*Primary Examiner*—R. J. Hickey

*Attorney, Agent, or Firm*—Weingarten, Schurgin & Gagnebin

[57] ABSTRACT

A stereo enhancement system utilizes a difference signal derived from the left and right stereo channels in which the difference signal is delayed, amplified, and then added into the appropriate channels to cancel left/right speaker mixing at the listener's ears, thereby to improve stereo separation without center region distortion. Depending on the amplification level of the difference signal, an increase in the perimeter sound over that produced at the central region gives a "wrap around" effect with only two speakers by increasing the volume of only the left/right directional sound components relative to centrally located sounds which have no left/-right directionality. In order to compensate for the angle between the listener and the speakers, a continuously variable delay is provided in the 100 microsecond −1 millisecond range by the utilization of a serial analog delay bucket brigade device. Ultrashort delays are created, in one embodiment, by utilizing equal delays in the left and right stereo channels. The difference signal is then delayed by an amount equal to either of the two initial delays plus the amount of desired delay. When serial analog delay devices are utilized, the clock rate of the delay line used for the difference signal is made slightly lower than the clock rate of the delay lines utilized in initially delaying the left/right signals, thereby to provide for ultrashort delayed difference signals. Off-center listener positions are accommodated by a further continuously variable delay line in one or the other of the left and right channels. In alternative embodiments to minimize the noise characteristic of analog delay devices, the input signal to the device is compressed, followed by expansion of the output signal from the device.

5 Claims, 6 Drawing Figures

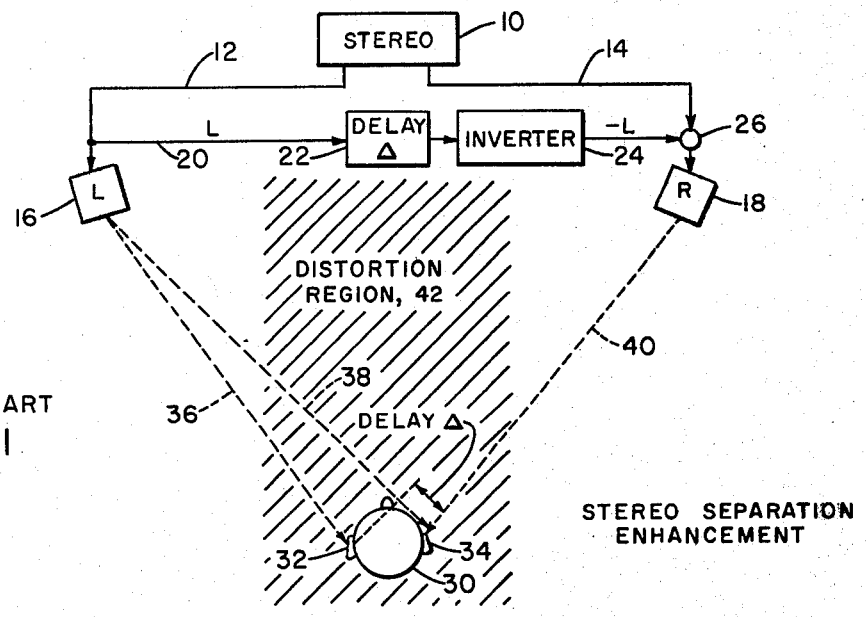
PRIOR ART
FIG. 1
FIG. 2
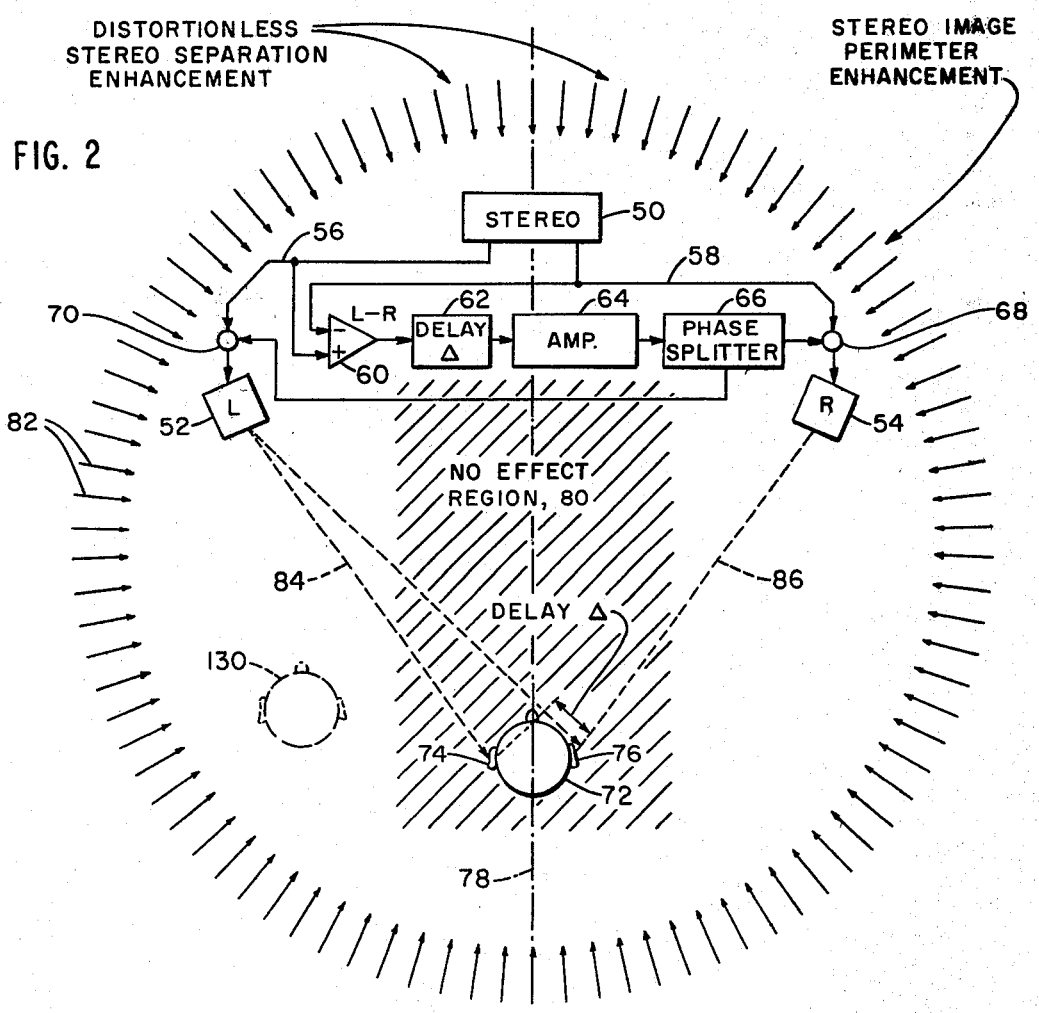

STEREO IMAGE SEPARATION AND PERIMETER ENHANCEMENT

RELATED APPLICATIONS

This application is a continuation-in-part of U.S. application Ser. No. 129,971, filed Mar. 12, 1980, now U.S. Pat. No. 4,308,423.

FIELD OF INVENTION

This invention relates to stereo reproduction techniques and more particularly to a method and apparatus for either increasing stereo separation or enhancing perimeter sound images, or both utilizing analog delay devices and noise reduction circuitry.

BACKGROUND OF THE INVENTION

In the past, complete separation of stereo signals has been accomplished through the utilization of ear phones in which a left channel is applied to the left ear phone and the right channel is applied to the right ear phone. While in 1960 Benjamin Bauer of CBS Laboratories described an effort to make ear phones sound more like loud speakers by simulating the delayed leakage of the left speaker output to the right ear of a listener and vice versa, up until recently, there has been very little effort made to increase stereo separation when utilizing loud speakers.

It will be appreciated that there is a certain amount of mixing of sounds from the left and right speakers at the listener's ears due to the fact that sounds from the left speaker, for instance, will arrive first at the left ear, then at the right ear of a listener. The sounds which arrive at the right ear are mixed with sounds arriving at the right ear from the right channel speaker. Thus the separation which was initially established by virtue of recording techniques is in some sense destroyed since one ear can hear sounds produced by both of the stereo speakers.

While Benjamin Bauer did suggest the aforementioned method to make ear phones sound more like loud speakers, he also suggested the reverse; that it would be possible to cancel stereo mixing when using loud speakers and suggested that this would give loud speakers the separation of head phones.

Subsequent work on stereo loud speaker separation was done in Germany by Damaska et al. In the Damaska et al system, the right signal is delayed by the transit time for a sound to crossd the listener's face to the left ear. This delayed signal is then frequency contoured, inverted and added to the left speaker signal. The correction signal in the left speaker is then used to acoustically cancel the right speaker leakage at the left ear. The same is done between the left and right channels such that acoustic cross-talk between the ears is presumably cancelled.

One of the basic difficulties with delaying the left channel or right channel speaker signals is that there is a broad central region in which there is a "muddying" effect. This effect is due to the utilization of the full left and right channel signals. Note, in the central region no left/right information exists and this signal is essentially a monaural signal. As a result, not only is there frequency distortion, but also volume attenuation. The frequency distortion is due to a comb filtering effect in which the levels of various frequency components are increased or decreased in the central region. Thus the clarity and fidelity of the original recording is lost for central region produced sound.

Moreover, in most recordings the most important sound producing instruments or performers create their sound at center stage. Thus the muddying or frequency distortion of sounds at center stage creates significant problems in a stereo reproduction system when utilizing the aforementioned enhancement technique.

SUMMARY OF THE INVENTION

Rather than utilizing the full left or right channel signal, delaying it, inverting it and then inserting it in the opposite channel, the subject system achieves separation by utilizing a left minus right difference signal delaying it, frequency contouring it, and inserting it into the left channel and its inverse into the right channel. In one embodiment, this is accomplished by feeding the left and right channels to a difference amplifier, the output of which is delayed by a bucket brigade device such as a serial analog delay, which is clocked at the appropriate rate for the required delay. The output of the delay unit is then amplified, and then coupled to a phase splitter which inserts right minus left channel signals into the right channel and left minus right channel signals into the left channel. In so doing, sounds which have no left/right directionality, such as those emanating from center stage, are not delayed or inverted and in fact are not utilized. This leaves the center stage sounds completely undistored, with no comb effect being superimposed.

In one embodiment, the types of delays to be produced are ultrashort and on the order of between 100 microseconds and 1 millisecond. These delays are not easily produced. They are produced in the subject system by the utilization of a serial-analog delay (SAD) such as a bucket brigade device. These delay devices are clocked, in one embodiment at close to 3 Mega-Hertz, which is ten times the normal rate, to achieve delays as short as 100 microseconds. In an alternative embodiment, in order to achieve a further shortness in the acoustic delay or allow use of slower SADs, SADs of equal delay are inserted into the left and right channels with a third delay used for the difference signal. The third delay may be provided by an SAD device which is clocked at a rate slightly lower than the rate at which the delay lines for the undifferenced signals are clocked, with the difference in clocking rates determining delays as short as ten microseconds or less.

In another embodiment, the noise associated with serial-analog delay devices is minimized through the utilization of amplitude compression of the input signal to the SAD device, followed by amplitude expansion of the signal from the SAD device. In one embodiment the compression is 2:1 with the expansion 1:2. Amplitude compression and expansion circuits are commercially available and manufactured in one instance as Signetics Model 570. The purpose of the amplitude compression is to decrease the dynamic range of the SAD input signal thereby bringing the low level portion of the signal up with respect to the noise and the high levels down with respect to the overload point of the SAD device. By decreasing the dynamic range, signals are presented to the SAD which are delayed in a more noise free manner, as the signals exist at the midpoint in the operating range of the SAD. After the SAD, the dynamic range is restored with an expansion circuit, and the noise normally introduced by the SAD is substantially reduced by the process of expansion.

By the utilization of variable clock rates, continuously variable delays may be utilized which can compensate for listener position between the two speakers. This is an important aspect of the subject invention, since fixed delays will produce the required separation only at a given angular location relative to the two speakers. Rather than having to drag around the speakers, a variable delay, provides that a listener may provide for maximum separation regardless of his angular relationship to the speakers. In one embodiment, the delay is set by merely determining the ratio between the distance that separates two speakers versus the distance between the left speaker and the listener's left ear.

For off-center listening in one embodiment, a broad band delay may be utilized in one channel to compensate for a listener being closer to one of the two speakers.

It has been found, that in addition to achieving excellent separation, a "wrap around" sound can be achieved which is akin to the positioning of as many as one hundred speakers around the periphery of the room. This effect is achieved with only two loud speakers. In the subject system this is accomplished by amplifying the output of the delay circuit beyond the level required for image separation. What this achieves is as much as a ten dB volume increase in the perimeter or peripheral sound level over the central sound level, since it is only the left/right components which are amplified and inserted in this manner. This peripheral enhancement is achieved without center image distortion and may be varied by the listener to his own listening requirements.

Further, it has been found that peripheral enhancement is effective to an adequate extent at positions removed from the position at which separation enhancement is maximal. Thus, peripheral sound enhancement may be achieved for listeners in the room at different positions, although the separation effect will be diminished for positions at the room's perimeter.

The image separation and peripheral sound enhancement corresponds to speakers capable of projecting sounds at 180 degrees as opposed to the 40–60 degrees of typically placed speakers with respect to the listening position. Thus, in one aspect of the subject invention, the utilzation of the subject system results in a spreading of the apparent audio source beyond the angle of the loud speakers toward that of the original sounds with respect to the microphones originally used in the recording. Not only is there a left/right spreading effect, but also there is better spreading of the forward and rear portions of the performance, such that a total immersion in sound is achieved by this process.

By so doing, the subject system does not affect the frequency response of the central image and therefore monaural or centrally located equal volume and phase signals in each channel are not adversely affected.

It will be appreciated that most rumble is produced by the vertical movement of the stylus which corresponds to the left/right signal, while very low frequencies contain no left/right components. By utilizing a high pass filter having a low frequency cut off of approximately 70 Hertz, for the difference signal, rumble which is produced by vertical motion of the stylus in the recording or reproduction of a record is not accentuated in the subject system while bass response is not affected.

DESCRIPTION OF THE DRAWINGS

The invention will be more fully understood from the following detailed description taken in conjunction with the accompanying drawings of which:

FIG. 1 is a diagramatic representation of a prior art system for stereo separation enhancement, indicating a centrally located distortion region;

FIG. 2 is a diagramatic representation of the subject stereo separation and perimeter enhancement system illustrating diagramatically the perimeter enhancement and distortionless stereo separation enhancment effectuated by the subject system;

DETAILED DESCRIPTION

Figure 3:
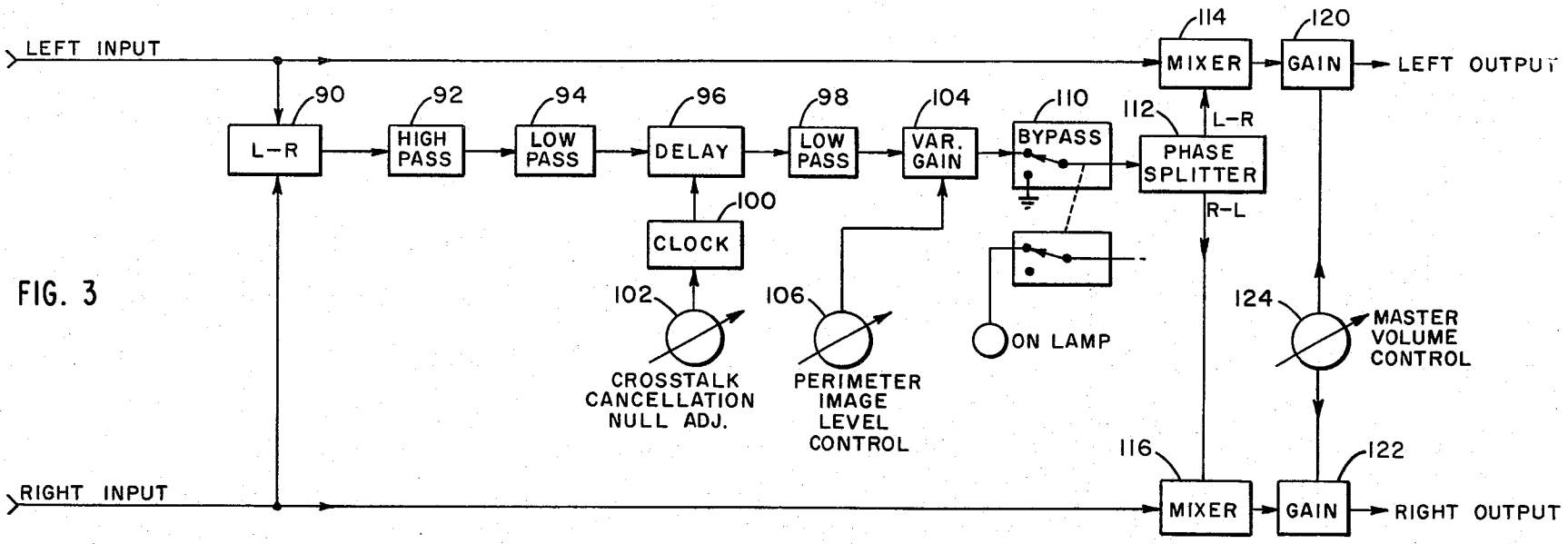
FIG. 3 is a block diagram of one embodiment of the subject system.

Referring now to FIG. 1, in a typical prior art system, a stereo unit 10 which may be a receiver, an amplifier, or any type of equipment which produces left and right channel signals, is coupled via lines 12 and 14 respectvely to left and right speakers 16 and 18. With respect to left channel to right channel cancellation, a line 20 is coupled from the left channel line 12 to a delay unit 22 which delays signals on this line by an amount Δ. The output of delay unit 22 is applied to an inverter 24, the output of which is applied to a mixer or summing point 26.

Assuming that the full left channel signal is indicated by the letter L, then the output of the inverter 24 is −L.

Assuming a listener 30 located midway between speaker 16 and 18 and assuming that the individual has a left ear 32 and a right ear 34, then, as can be seen from the diagram, sound may reach left ear 32 from speaker 16 along a line 36. Sound from this speaker will also reach ear 34 along a line 8 as it crosses the face of the listener. It will be appreciated from inspection of this diagram that the sound transmitted to the right ear travels a longer distance than the sound transmitted to the left ear and will be delayed at the right ear by an amount Δ corresponding to the difference in path length between the sound paths to both of the ears.

As can also be seen, sound impinges on right ear 34 from speaker 18 along a path 40 such that there exists at the right ear a certain amount of mixing of left and right channels. This destroys stereo separation to a certain extent.

In order to eliminate such mixing, delay unit 22 and inverter 24 couple an inverted left signal into the right channel so as to exactly cancel the left channel signal at the right ear. Thus at the right ear, a delayed and inverted left channel signal arrives at the same time as the left channel signal, with the delayed inverted left signal cancelling the signal which arrives from the left speaker.

It will be appreciated that for cancellation at the left ear, a reverse type situation is envisaged in which the right channel is delayed by Δ, inverted and then coupled into the left channel.

In so doing, a distortion region 42 is created which occupies generally the center region between the two speakers in which sound in this region is "muddied". What this means is that there is frequency distortion due to a comb filtering effect because the entire left channel signal is inverted, delayed, and mixed with the right channel signal vice versa.

While stereo separation is in fact enhanced by the system illustrated in FIG. 1, signals lacking left/right directionality, will be significantly attenuated and distorted in the central region illustrated.

Referring now to FIG. 2, a system is illustrated in which not only is there distortionless stereo separation enhancement, but also perimeter enhancement.

In the embodiment illustrated stereo unit 50 is coupled to left and right speakers 52 and 54 respectively, via respective lines 56 and 58. A difference amplifier 60 is coupled across lines 56 and 58 such that a left minus right difference signal is coupled to a delay unit 62 which delays the signal by an amount described hereinabove. Thereafter, the signal from delay unit 62 is amplified at 64. The signal from the amplifier 64 is applied to a phase splitting circuit 66 which inverts the amplified signal and couples right minus left directional signals to a summing node or mixer 68 interposed in the right channel, and left minus right channel signals into a summing node or mixer 70 interposed in the left channel. A listener 72 having a left ear 74 and a right ear 76 is located along a center line 78 which defines the midpoints between the left and right speakers.

In operation, the system responds to the difference signal between the left and right channels, delays it by an amount Δ, and in some cases amplifies it at which point it is applied to the phase splitter. By this operation, that which is subtracted from the right channel is the purely directional left channel signal, whereas that which is subtracted from the left channel is the purely directional right channel signal. It will be appreciated that monaural signals having no left/right information, or signals coming from center stage which have no left/right information, will be ignored by this system. Thus the central region 80 is one in which the subject system has no effect and in which no distortion occurs.

With proper adjustment of the amplifier section of unit 64 sounds coming from the periphery can be made to have a level equal to that of sounds which originated from center stage. This results in extremely effective stereo image separation and eliminates close to if not all of the cross-mixing of signals from the two speakers at the listener's ears.

Assuming listener 72 is located along the center line, then the amount of delay Δ is established by measuring the distance between the two speakers and by measuring the distance from the left speaker to left ear 74. This ratio establishes the optimum delay via the geometry and if the delay is easily variable as will be discussed, adjustment may be either in accordance with this ratio or when the listener hears maximum separation in the stereo signals.

An alternative method of establishing delay Δ is to measure the angle between lines 84 and 86 and to establish the above-mentioned ratio by the utilization of the indicated trigometric relationship.

It is a finding of this invention, that not only is separation enhanced in this distortionless fashion, but also peripheral sound which exists about the perimeter may be artificially enhanced to give an exceedingly pleasing effect of "wrap around" sound. This is accomplished by amplifying the signal from the delay line by an amount of excess of that which corresponds to the level of sound which exists in the central region. This may be increased by as much as ten dB to give the effect of having been surrounded completely by the sound. The effect, as noted hereinbefore, is equivalent to having the whole perimeter of the room lined with speakers, each projecting inwardly such that sound is projected as illustrated by arrows 82 towards the center of the room and towards the listener.

It will be appreciated that it is the perimeter sound which is amplified due to the difference signal processing. In short, since monaural or directionless signals are not amplified, it is the signals which have a directionality, either left or right, which are amplified and inserted into the left and right channel speakers.

Referring now to FIG. 3, an expanded block diagram is utilized in describing the subject system. In this case, a differential amplifier performing as a left/right descriminator is illustrated at 90 to which is coupled a left input and a right input as illustrated. The output of the left/right descriminator 90 is a left minus right signal which is applied to a rumble reducing high pass filter 92, to an anti alias low pass filter 94 and finally to a delay line which, in one embodiment, is a serial-analog delay such as manufactured by Reticon Corporation. This is basically a bucket brigade device which is clocked via clock 100 under control of a variable control unit 102. The output of delay line 96 is applied to a low pass filter 98 which removes clocking components and lowers the high frequency content to compensate for the different response of the intended and other ear. The resultant signal is then applied to a variable gain amplifier 104 under control of a control unit 106. The output of the variable gain unit is applied to a by-pass switch 110 and thence to a simple phase splitter 112 to generate the left minus right and right minus left correction signals. The output of phase splitter 112 is applied to mixers 114 and 116 respectively in the left and right channel lines. In this embodiment, the output of each mixer is applied respectively to an additional amplifier 120 and 122 which are variable gain amplifiers under control of a master control 124. The outputs of these amplifiers are then applied to external left and right power amplifiers and speakers.

It will be appreciated that utilizing the serial analog delay unit for delay unit 96 produces a delay which is continuously variable. The delaying of acoustic signals for ultrashort delay times is not an easy matter and has in the past been done with lumped constant elements. These circuit elements provide shifts in phase which are in general fixed at the factory. Therefore there is no ready adjustability for listener angle with respect to the speakers.

In the subject system, however, this delay may be continuously varied so that maximum separation at a wide range of listener positions may be achieved. Thus adjustment unit 102 is in effect a cross-talk cancellation null adjusting unit and may be adjusted via remote control by the listener as he listens to his stereo recordings.

Low pass filter 94 interposed to take out ultrasonic signals that might beat with the delay clock frequency and high pass filter 92 is interposed so as to remove rumble under seventy Hertz. Note, as a conventionally accepted principle there is very little left/right information below one hundred or so Hertz. Thus by providing the high pass filter with a roll-off at seventy Hertz, no left/right information or overall bass level is lost in the process. This corrects for rumble which is usually produced by vertical stylis action within the grooves of the record, produced either during recording or reproduction.

Figure 4:
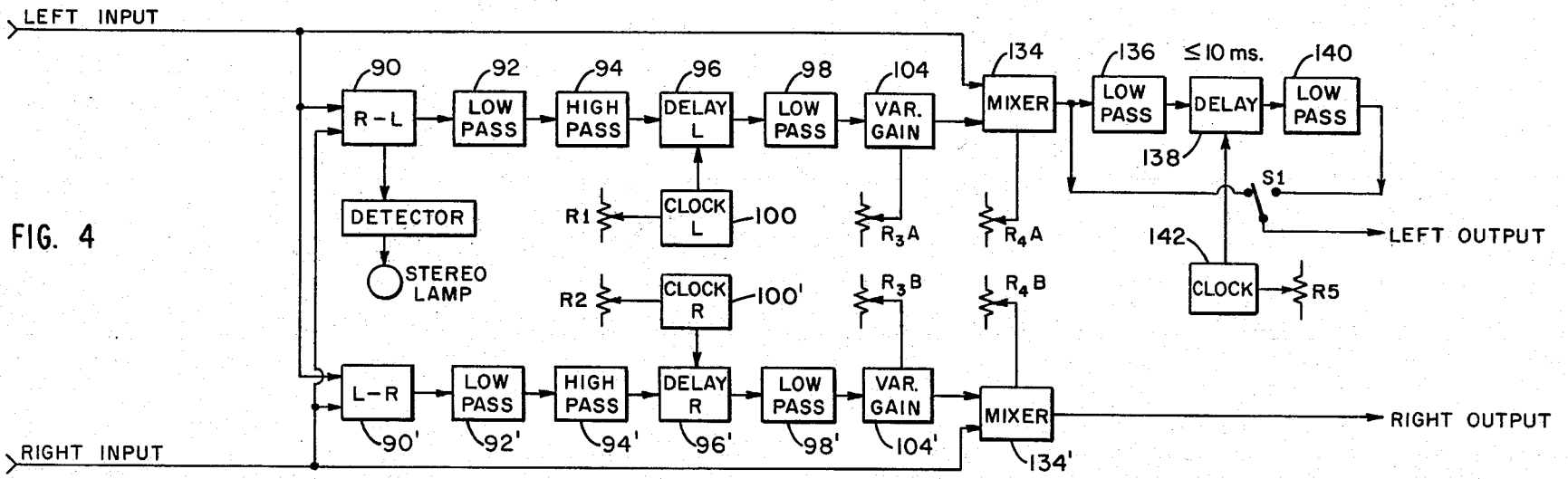
FIG. 4 is a block diagram of another embodiment of the subject system in which off-center listener positions may be accomodated.

Referring now to FIG. 4, this embodiment is utilized for the off-center listener. This off-center listener may be located for instance as in FIG. 2 at position 130. The off-center position may be necessitated by furniture in the room or the inability to locate speakers in precisely a spot which would place the usual listening position at a point midway between the speakers. As can be seen, units 90, 92, 94, 96, 98 and 104 have been duplicated for each of the channels as illustrated by units 90', 92', 94', 96', 98' and 104'. In this embodiment, a phase splitter is not utilized to separate the signals to be fed back to the right and left channels. This function is accomplished by duplication of the various units. They function in the same manner and are adjusted as by potentiometers R1 and R2 for a listener located on a center line at some distance from the speakers as measured along a line perpendicular to the line joining the two speakers.

Variable gain amplifiers 104 and 104' are controlled respectively by potentiometers R3A and R3B to achieve whatever gain is required either for enhancement or for absolute stereo fidelity.

The outputs of variable gain amplifiers 104 and 104' are coupled respectively to mixers 134 and 134' coupled into the left channel right channel lines respectively. The mixers may themselves be amplifiers and their amplitude is adjusted through potentiometers R4A and R4B as illustrated.

Assuming that the listener is off-center to the left as illustrated, the output from mixer 134 is applied to a low pass filter 136, to an additional serial analog delay line 138 and thence to a further low pass filter 140 from which point it is applied as the left channel output via switch S1.

Delay 138 is clocked by a clock 142 controlled by potentiometer R5 and has a delay greater than or equal to ten microseconds in one illustrative embodiment.

The purpose of delaying the left channel signal over the right channel signal is that the off-center listener in the above case is closer to the left channel speaker. Thus he will be receiving signals from the left channel speaker before signals from the right channel speaker arrive. In this manner, the system may be adjusted for off-center listeners, with the right channel being provided with the same type of delay unit should the listener be off-center to the right.

Figure 5:
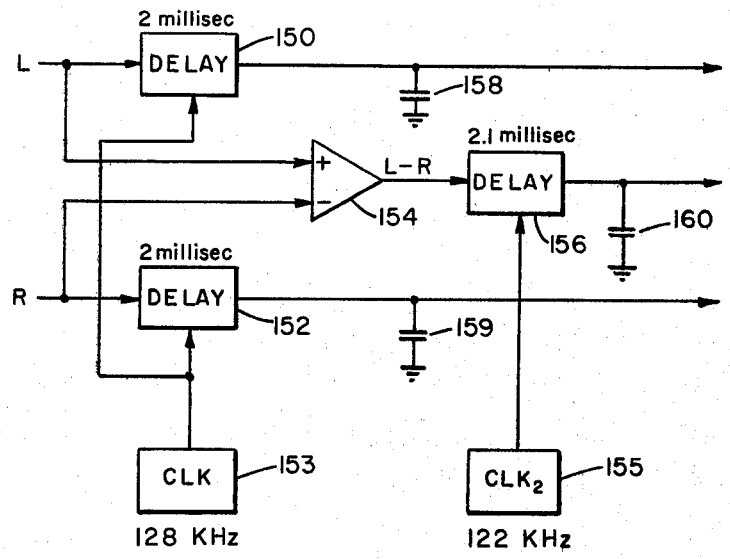
FIG. 5 is a schematic and block diagram of one embodiment of the subject invention in which ultrashort acoustic delays are produced through the utilization of a double delay technique; and, FIG. 6 is a schematic diagram showing the use of amplitude compression and expansion circuits to reduce SAD nose.

Referring to FIG. 5, as has been mentioned hereinbefore, it is with some difficulty that ultrashort acoustic delays are achievable. This is because in standard low noise SAD lines there are 512 different charge transfer elements such that the delay line is said to be 512 units long.

In order to utilize these standard delay units, and with their ultimate limit in clocking frequency, it is possible, in the subject case and in others, to achieve shorter delays through the utilization of three of these devices.

In this embodiment, analog delay lines 150 and 152 are interposed in the left and right channel lines as illustrated and are clocked identically, for instance, at a clock rate of 128 KiloHertz. This gives a two millisecond delay for each line. The left and right inputs are also coupled to a differential amplifier 154, the output of which is coupled a third analog delay line 156. This analog delay is clocked at a rate slightly less than delays 150 and 152, for instance at 122 KiloHertz. This provides for a 2.1 millsecond delay such that the overall delay of the left minus right signal with respect to the left and right signals is 0.1 millisecond or 100 microseconds. It can thus be seen that relatively short delays can be achieved between any two signals by the use of this differential delay technique.

It will be appreciated that in the embodiment shown in FIG. 5, the delayed left or right channel signals and the difference channel may be appropriately mixed to achieve the stereo enhancement.

In general, this technique may be utilized when it is desirable to delay any one signal with respect to another and the desired delay is too short to be achieved through the clocking of an existing serial analog delay line. In this case, the delays in each of the lines are made different so the desired delay is obtained as the differential.

Note, capacitors 158, 159 and 160 are used as low pass filters to remove all clock fundamentals, thereby to avoid clock difference frequencies from appearing in the outputs.

This system is useful when bandwidth is not critical, i.e., when the maximum signal frequency is much much less than the clock frequency. Thus the system is useful for short delays at bandwidths less than $\frac{1}{3}$rd the clock frequency.

Figure 6:
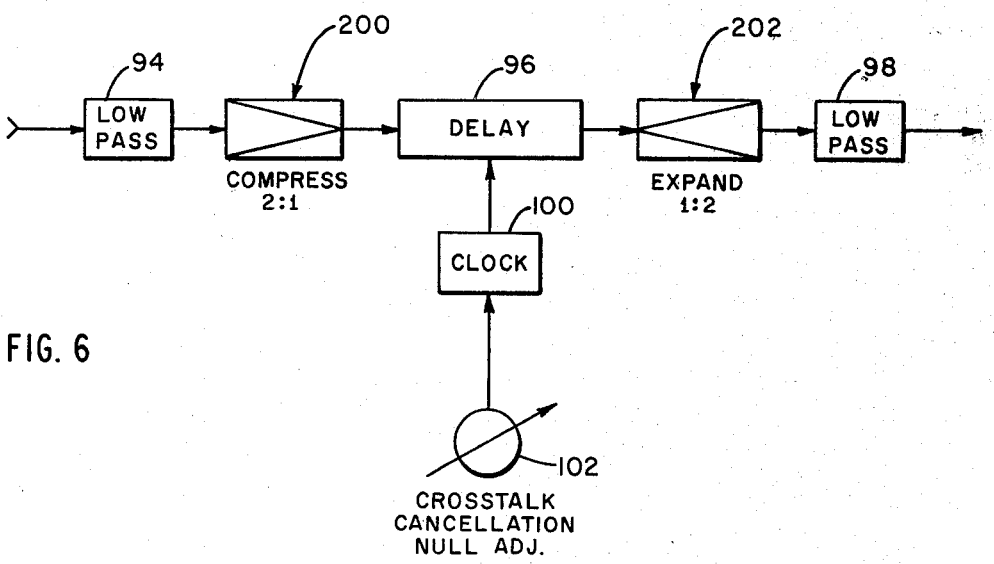

Referring now to FIG. 6, a system for eliminating noise associated with SAD type devices is illustrated. In this Figure, a 2:1 amplitude compression circuit is interposed between low pass filter 94 and delay 96 of FIG. 3; and a 1:2 amplitude expansion circuit is interposed between delay 96 and low pass filter 98 also of FIG. 3.

In operation, compression circuit 200 decreases the dynamic range of the input signal to the SAD such that low level portions of the input signal are raised with respect to the noise level, whereas high level portions of the input signal are brought below the overload point of the SAD device. This presents the SAD with an ideal signal lying right in the middle of its dynamic range. When the SAD processes this compressed signal it introduces the least noise it can based on its most optimistic operating characteristics. Thereafter full dynamic range is restored by expansion circuit 202. The result is that since the SAD is operated at its best noise free point, the effect of using an SAD is minimized in terms of the noise introduced.

Secondly the expansion also reduces the noise as can be seen by the following example. Taking a low level input signal at −30 dB, compressing it raises it to −15 dB with a 2:1 compression. The noise level of the SAD is typically −40 dB so that without processing, the low level −30 dB signal is only 10 dB above the SAD noise level of −40 dB. By compressing and then expanding after the SAD in the doubling process, the −15 dB input signal is restored to −30 dB, but the −40 dB noise of the SAD reduced to −80 dB. Thus the output signal is 50 dB above noise.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed:

1. Apparatus for noise limited stereo image separation and perimeter enhancement for use with stereophonic audio reproduction means having left and right channel outputs, comprising:

means for deriving a difference signal from the signals in said left and right channel outputs;

means for amplitude compressing said difference signal;

a clocked bucket brigade device for delaying said amplitude compressed signal;

means for amplitude expanding said delayed signal; and, means coupled to said expanding means for phase splitting said expanded signal and coupling the two phases of said expanded signal into said left and right channels so as to subtract delayed left minus right and right minus left components from the correspondingly opposite channels.

2. The apparatus of claim 1 wherein said compression is 2:1 and said expansion is 1:2.

3. The apparatus of claim 1 wherein said expansion is the inverse of said compression.

4. The apparatus of claim 1 wherein said expansion exceeds the inverse of said compression.

5. The apparatus of claim 1 wherein said compression exceeds the inverse of said expansion.

* * * * *